US006786157B1

(12) United States Patent
Powell

(10) Patent No.: US 6,786,157 B1
(45) Date of Patent: Sep. 7, 2004

(54) HOLLOW CHARGE EXPLOSIVE DEVICE PARTICULARLY FOR AVALANCHE CONTROL

(76) Inventor: Kevin Mark Powell, 170 London Road, Dunton Green, Kent TN13 2TA (GB)

( * ) Notice: Subject to any disclaimer, the term of this patent is extended or adjusted under 35 U.S.C. 154(b) by 0 days.

(21) Appl. No.: 10/089,418

(22) PCT Filed: Sep. 29, 2000

(86) PCT No.: PCT/GB00/03751

§ 371 (c)(1),
(2), (4) Date: Sep. 30, 2002

(87) PCT Pub. No.: WO01/25717

PCT Pub. Date: Apr. 12, 2001

Related U.S. Application Data

(63) Continuation-in-part of application No. 09/412,764, filed on Oct. 1, 1999, now abandoned.

(51) Int. Cl.[7] ..... F42B 12/02
(52) U.S. Cl. ..... 102/476; 102/306
(58) Field of Search ..... 102/306–310, 102/398, 476

(56) References Cited

U.S. PATENT DOCUMENTS

| | | | | |
|---|---|---|---|---|
| 1,446,664 A | | 2/1923 | Saucier | |
| 2,416,077 A | | 2/1947 | Yuster | 102/20 |
| 2,656,003 A | | 10/1953 | Poulier | 181/5 |
| 2,674,945 A | | 4/1954 | Marsh | 102/28 |
| 2,972,948 A | | 2/1961 | Kray | 102/56 |
| 3,129,665 A | * | 4/1964 | Evans, Jr. | 102/476 |
| 3,477,372 A | | 11/1969 | McFerrin et al. | 102/24 |
| 3,664,262 A | | 5/1972 | Rose et al. | 102/56 |

FOREIGN PATENT DOCUMENTS

| | | |
|---|---|---|
| CA | 934224 | 9/1973 |
| CH | 369 158 | 5/1963 |
| DE | 1 130 746 | 2/1962 |
| DE | 1 136 920 | 12/1963 |
| DE | 2 306 889 | 8/1974 |
| DE | 23 52 896 | 5/1975 |
| DE | 25 00 152 | 7/1975 |
| DE | 3405527 | 6/1985 |
| DE | 38 34 491 | 4/1990 |
| DE | 43 02 252 | 9/1993 |
| FR | 977.378 | 3/1951 |
| FR | 1.525.339 | 9/1968 |
| GB | 852428 | 10/1960 |
| GB | 1084972 | 9/1967 |
| GB | 2351797 | 1/2001 |
| WO | 80/01511 | 7/1980 |

OTHER PUBLICATIONS

Copy of the UK Search Report dated Sep. 22, 1999.
Copy of the European Search Report dated Dec. 5, 2000.

(List continued on next page.)

*Primary Examiner*—Michael J. Carone
*Assistant Examiner*—James S. Bergin
(74) *Attorney, Agent, or Firm*—Nields & Lemack

(57) ABSTRACT

A shaped charge explosive device (10) comprising an explosive charge body including an explosive charge (18) defining a cavity particulate material (44) dispersible by the explosive charge when detonated, eg in a liner lining the cavity. In a preferred embodiment of this device of particular applicability to use in avalanche control, the particulate medium is aluminium. This is energized by the liner collapse and jetting process such that on impact and interaction with a snow/ice target it gererates a directed blast effect extending beyond that achievable with a simple blast charge of the same mass. Direct application to hand charge avalanche control methods and modified ammunition for Avalauncher ammunition are presented. Two of such charges with a conical liner can be positioned either facing each other or facing away form each other to obtain a particular blast pattern.

15 Claims, 7 Drawing Sheets

U.S. PATENT DOCUMENTS

| | | | | | |
|---|---|---|---|---|---|
| 4,023,494 | A | | 5/1977 | Barton et al. | 102/24 R |
| 4,187,782 | A | | 2/1980 | Grace | 102/56 |
| 4,259,906 | A | | 4/1981 | Krauch, Jr. et al. | 102/56 SC |
| 4,455,914 | A | * | 6/1984 | Christmann et al. | 102/476 |
| 4,499,830 | A | | 2/1985 | Majerus et al. | 102/476 |
| 4,794,990 | A | | 1/1989 | Riggs | 166/902 |
| 4,817,529 | A | | 4/1989 | Schippers | 102/302 |
| 5,259,317 | A | | 11/1993 | Lips | 102/307 |
| 5,705,768 | A | | 1/1998 | Ey | 103/307 |
| 5,847,312 | A | | 12/1998 | Walters et al. | 102/309 |
| 5,872,326 | A | * | 2/1999 | Manhart | 102/439 |

* cited by examiner

HOLLOW CHARGE EXPLOSIVE DEVICE PARTICULARLY FOR AVALANCHE CONTROL

This application is a continuation in part of application Ser. No. 09/412,764, Oct. 1, 1999 abandoned.

This invention relates to explosive devices commonly referred to as hollow charges or shaped charges. These essentially comprise a symmetric explosive charge within which is formed a cavity lined by a lining material. When the explosive charge is detonated the liner, of metal in known devices, is subject to extremely high compressive loads which act to collapse and eject the liner material in the form of a high speed fluid jet, normally followed by a more slowly moving rigid slug. The charge and liner may be rotationally symmetric or non axi-symmetric, for example with a liner with a "V" cross section, used for cutting operations.

There are a number of industrial applications for shaped charge devices where rapid penetration effects are required in awkward and inaccessible places. An example is to initiate or increase the yield of oil & gas wells. In this case a number of charges are arranged to fire radially outwards at the base of the well. Upon detonation the shaped charge jets perforate the steel well casing, surrounding concrete grouting and then penetrate deeply into the oil/gas bearing rock, producing a series of discrete channels through which the oil and gas can flow into the well conduit. Another application is perforation and clearance of refractory bung at the base of a steel smelting crucible. The most extensive use, however, is in the military context against heavily protected targets such as tanks and shelters and for a wide range of battlefield engineering applications. In all these cases the shaped charges are designed and applied to exploit their penetration potential.

The present invention seeks to provide a shaped charge explosive device particularly suitable for use for avalanche control. However, the mechanism by which energy is distributed and imparted to the target medium by this invention offers potential for a number of alternative applications. The invention will be described in context with avalanche control applications first, followed by alternative applications.

Avalanches can present a serious danger to people and property when triggered in an uncontrolled manner, whether by a natural cause such as the weather conditions or unintentionally as a result of human activity such as skiing or climbing. It has therefore become an established practice in many mountainous areas to maintain a continuous programme of avalanche control using explosives to trigger a release. This practice of regularly triggering small controlled avalanches is intended to minimise the build up of snow in known start zones which, if left, would eventually release naturally and unexpectedly often cascading out of control. The current practices relevant to the present invention include the following.

Where avalanche start zones are inaccessible, an explosive charge can be delivered to the slope in the form of a projectile fired from a gun or mortar system where the projectile explodes on or shortly after impact. Short ranges (up to 3 km) can be covered by gas gun projector systems such as the nitrogen driven Avalauncher, used extensively in the US, Canada and Europe. Longer ranges demand high performance systems typical of military artillery and the 105 mm howitzer and 106mm recoilless rifle have been used in avalanche control operations for many years.

Fuzes in older military ammunition are designed to detonate upon impact, in soft snow, however, these fuzes tend to trigger well below the surface and quite probably not until the projectile strikes rock or firm ground. In fact, the ideal point of burst for avalanche release is several meters above the surface in proximity mode. However, with gun fired projectiles, this can only be achieved with an electronic proximity burst fuze. Since this type of fuze is both inhibitively expensive and notoriously unreliable against light, dispersed media such as snow, the performance of impact fuzing continues to be tolerated.

Most areas in ski resorts are accessible, including the mountain peaks, and this accessibility enables explosive charges to be delivered or placed by hand. The practice of positioning charges by hand is probably the most cost effective and extensively used method of avalanche control in many ski resorts, but carries with it obvious hazards in poor weather conditions. The hand charge is a relatively simple device consisting of a lightly cased (cardboard) explosive charge detonated by a length of capped pyrotechnic delay fuze. The fuze can be ignited and the charge thrown into a preferred position or the charge can be pre-positioned above the surface on a bamboo stick before the fuze is ignited.

It is acknowledged that various types of anti-tank ammunition, bearing shaped charge liners, have been fired into avalanche start zones in the past but this has been as a result of ammunition availability rather than an interest in the shaped charge effect. Results from this type of ordnance, designed specifically for high penetration into steel, has nevertheless been no different from standard artillery fragmenting shells because little of the jet energy can be dissipated into the snow pack.

The present invention seeks to provide an improved hollow charge explosive device for this and other applications.

Accordingly, the present invention provides a hollow charge explosive device including an explosive charge defining boundary walls of a cavity and including particulate material located forward of said boundary walls so as to be dispersible by said explosive charge when detonated.

The particulate material may be included in a liner lining the cavity or positioned elsewhere forward of the cavity, eg in a nacelle, or in both positions.

The particulate material, if present in a liner, is driven in the same way as that of a conventional shaped charge liner. However, in this case, the particulate medium forms into a highly energetic non-cohesive stream of particles, generally wider than that produced by a conventionally lined shaped charge. In this highly energised state, the low bulk density of the liner material and high surface area attributable to each particle of the liner material, together with the larger surface area of the jets cross section, facilitates an intimate and violent kinetically stimulated reaction with the target medium. Given a knowledge of the intended target material and its constitution, eg a snow slab, the liner material can be chosen to optimise the blast energy yield over and above that normally attributable to the explosive charge alone.

Conveniently, the liner may comprise an inner liner skin and an outer liner skin defining a space therebetween and the particulate material may be a loose powder contained in that space. In a one embodiment, the inner liner skin and outer liner skin are of a glass reinforced plastics material. The particulate material may be aluminium powder, particularly for use in avalanche control due to the potentially highly reactive nature of aluminium powder with water.

In an alternative embodiment, the particulate material may be embedded in an inert binder such as a plastics material, a was such as a paraffin was, or an adhesive matrix to aid manufacture, handling and assembly. The matrix material may also be conveniently chosen to make a net contribution to the reaction of the principal suspended particulate material.

Where a liner is not present, the high pressure and high temperature gaseous stream produced by the hollow cavity in the explosive focuses blast effects only along the axis of the charge. If a particulate material is located on the axis of the charge, typically in the nacelle, this material will be energised and dispersed by the high pressure and high temperature gases ejected from the cavity, thereby further enhancing the directed blast effects produced by the hollow cavity.

An explosive device assembly may be formed from two such explosive devices oriented such that the jets of liner formed on detonation of the charges are directed towards each other or away from each other.

When the jets are directed toward each other, the collision of the jets with each other provides an energetic response between the interacting jets. Two or more dissimilar liner materials may be provided in the explosive devices which when brought together in collision with each other and/or the target medium achieve an energetic response between associated interacting materials. This effect may also be further enchanced with additional particulate material located in the nacelle.

The devices may be gun fired, or otherwise hand thrown, or form part of a mechanically or chemically launched projectile.

An elongate support may be attached to the explosive charge body to aid hand positioning the device at the target.

The liner material may take any convenient form which can produce a shaped charge liner collapse mechanism, the so-called "Munroe effect", and typically include conical liner configurations and hemispherical and hemispherical cap geometries.

A method of triggering an avalanche according to the present invention comprises positioning an explosive device or explosive device assembly of the present invention in a predetermined position relative to a snow or ice formation and detonating said explosive device or device assembly.

Embodiments of the invention will now be described, by way of example only, with reference to the accompanying drawings of which:

Figure 1:
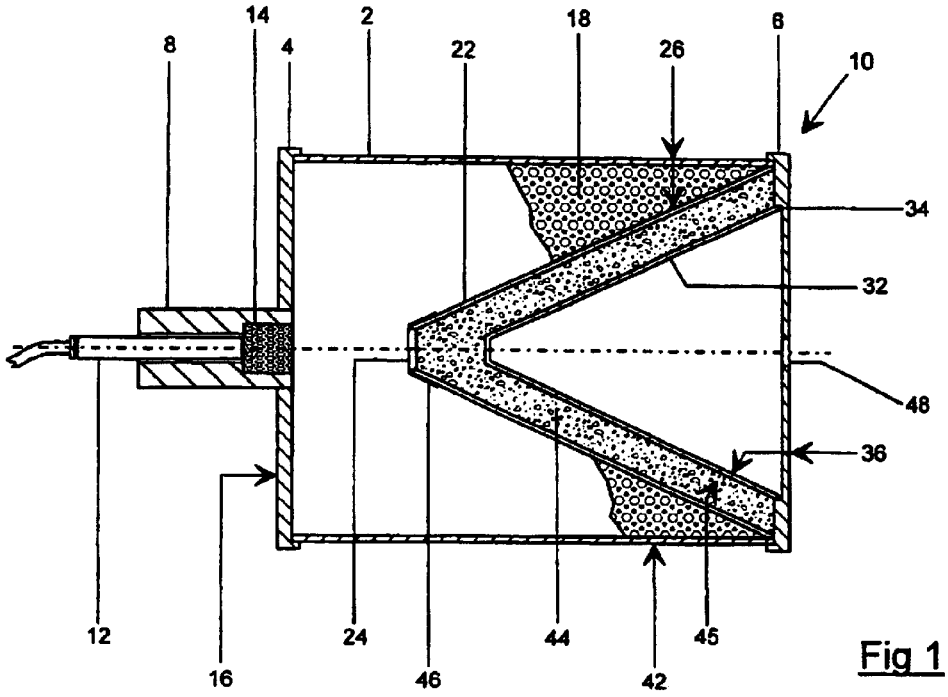
FIG. 1 is a diagrammatic sectional view of a first device according to the present invention.

Referring to FIG. 1, an explosive device 10 consists of a cylindrical GRP (glass reinforced plastic) body 2 located between a PERSPEX magazine locating plate 4 and PERSPEX liner locating plate 6. The magazine locating plate 4 centralises a PERSPEX unit 8 on the central axis of the device. The magazine unit 8 locates a detonator 12 and explosive booster pellet 14 to form an initiation cap assembly 16. The initiation cap assembly 16 ensures that the detonation front transferred into a main explosive filling 18, via the booster pellet 14, is propagated symmetrically with respect to the axis of the device 10. A GRP outer liner skin 22, with an open truncated apex 24 is bonded to the cylindrical body 2 to form a sub-assembly 26. An internal GRP conical liner 32, with a closed truncated apex, is bonded into the recess 34 machined into the liner locating plate 6 to form a sub-assembly 36. Sub-assemblies 26 and 36 are then joined and bonded to form a charge assembly 42 defining a conical void 44 concentric and aligned to the central axis of the device 10.

The material and grist size of a particulate liner cavity filling 45 is chosen to suit the nature of the target material involved. For avalanche control work, aluminium powder of 150 micron particle size is suitable, for example. The filling 45 is loaded into the void 44 through a filling port 24 at the apex of the liner 22. The filling port is then sealed with a disk of aluminium adhesive tape 46. The explosive filling 18 is then loaded into the charge assembly 42 and the charge is closed by fitting and bonding the initiation cap 16 in place. A hole 48 in the liner locator plate 6 allows pressure equalisation between the conical void enclosed by the inner liner skin 32 and liner locator plate 6 and external atmospheric pressure and has no other bearing on the function of the vice.

Figure 2:
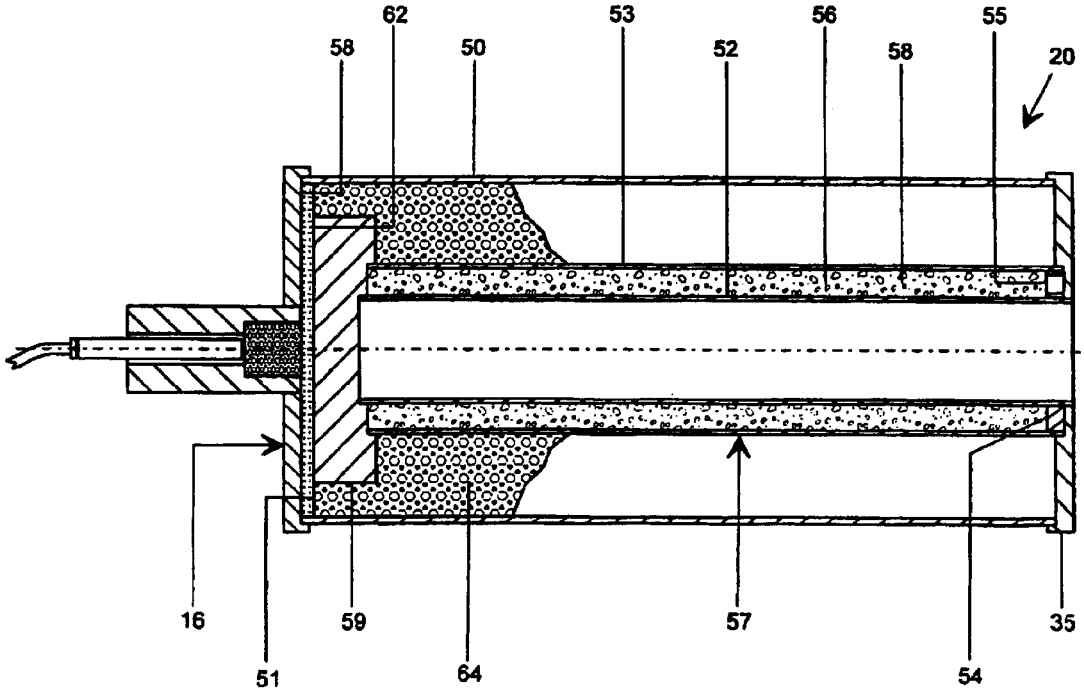
FIG. 2 is a diagrammatic sectional view of a second device according to the present invention.

Referring now to FIG. 2, a device 20 consists of a cylindrical body 50 located between an initiation cap 16 and a PERSPEX tubular liner assembly locator plate 35. The initiation cap 16 ensures that the detonation front is transferred into a radial detonation transfer disk 51, symmetrically disposed with respect to the axis of the device 20. An inner GRP tubular liner 52 and outer GRP tubular liner 53 are located co-axially between a polyethylene barrier plate 59 and the tubular liner assembly locator plate 35. The separation between the two tubular liners 52 and 53 is maintained by in insert 54 which is drilled with a single hole 55 to allow a void 56 defined by the liners 52 and 53 to be filled with aluminium powder 58.

The barrier plate 59, inner and outer tubular liners, 52 and 53 respectively, and insert 54 are bonded together to form a tubular liner assembly 57, The void 56 between the inner and outer tubular liners is filled with aluminium powder 58, of 150 micron particle size, through the filling hole 55 which is then sealed with a disk of aluminium adhesive tape, (not shown). The radial detonation transfer disk 51 is bonded to the inner face 58 of the initiation cap assembly 16 and the barrier plate 59 of the tubular liner assembly 57 is bonded concentrically to the outer face 62 of the radial detonation transfer disk 51. A main explosive filling 64 is filled into the charge assembly from the open end opposite the initiation cap 16 and closed and sealed by fitting and bonding the tube locator plate 34 in position.

Figure 3:
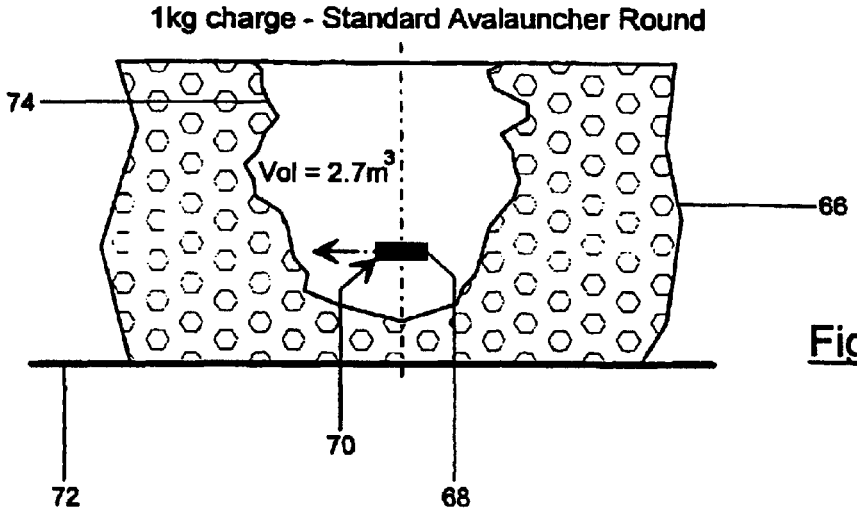
FIGS. 3, 4 and 5 are diagrammatic views of the results of recent experimental cratering trials conducted against level and stable snow pack.
Figure 4:
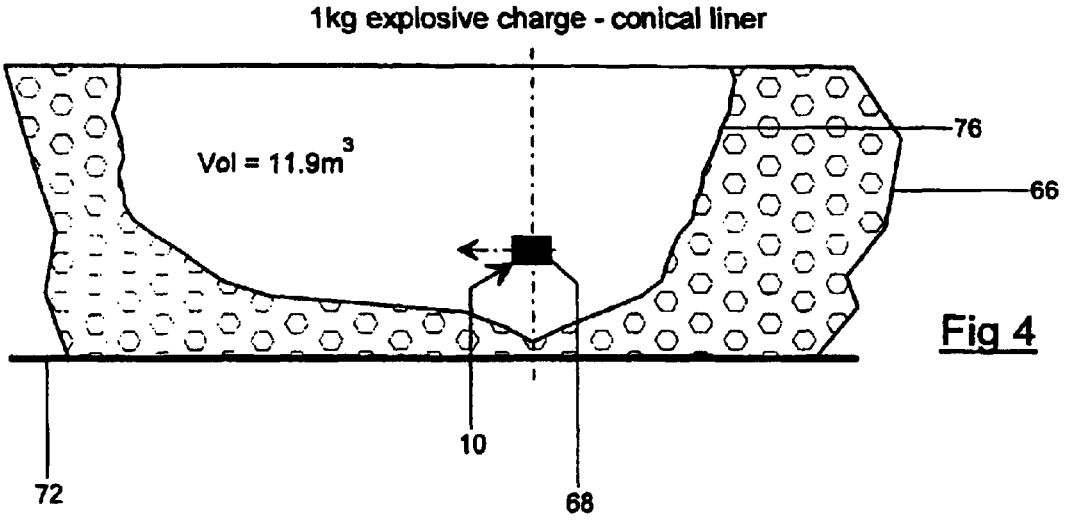
Figure 5:
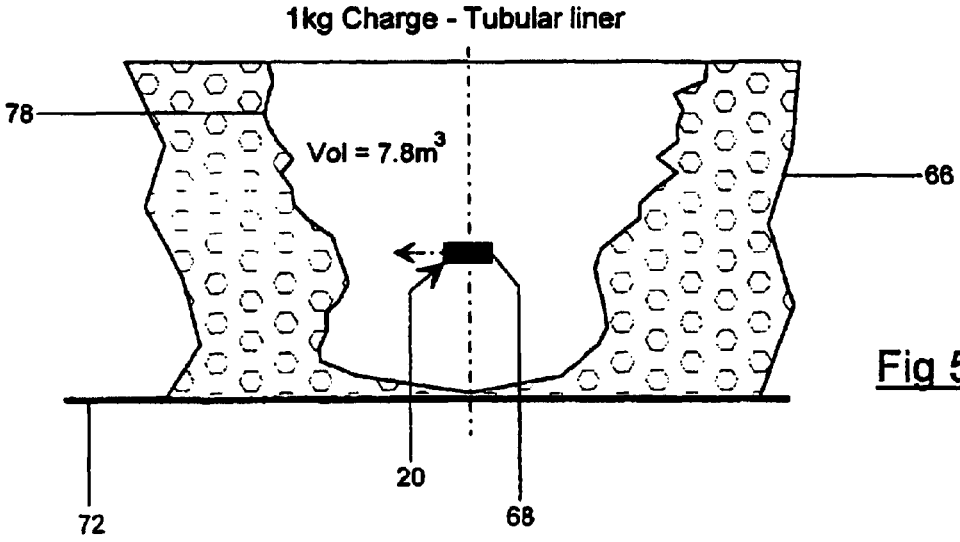

FIGS. 3, 4 & 5 show the results of experimental cratering trials of the explosive device of FIG. 1 conducted against a level and stable snow pack 66. Each charge was set 1.2 m below the snow surface such that its axis was horizontal and the point of detonation 68 arranged such that any bias would be driven in the direction of the arrow. After firing, the craters were sectioned to reveal the profiles shown in the figures. The depth of the snow base is indicated by a solid black line 72

The profile 74 shown in FIG. 3 was produced by a 1 kg blast explosive charge 70. The charge was 68 fired to establish a control standard against which the experimental charge firings of devices according to the present invention could be compared. The profile was symmetrical about the vertical axis and yielded a crater volume of 2.7 cubic meters.

The profile 76 shown in FIG. 4 was produced by the device 10 described earlier and shown in FIG. 1. The explosive content was also 1 kg. The effects of the conical liner are clear. The crater was elongated as a result of the penetration and subsequent secondary reaction of the shaped charge jet. A significant increase in the energy transmission into the snow pack was evident, the crater volume increasing from 2.7 to 11.9 cubic meters.

The profile 78 shown in FIG. 5 was produced by the device 20 described earlier and shown in FIG. 2. The explosive content was also 1 kg. This liner configuration produced more localised reaction of the liner material. The crater volume was increased from 2.7 to 7.8 cubic meters. This was less than that produced by the conical liner configuration. of device 10 but particularly high shock emission was evident from the ground shock detected and extensive secondary surface spalling at the inner surface of the crater.

There will now be described exemplary applications of the device 10 of FIG. 1. It should be note that the applications are equally valid for the device 20 of FIG. 2 and liner geometries that fall between the two, the choice being made to suit the characteristics of the particulate loading material, operational environment, cost, and target medium involved.

Figure 7:
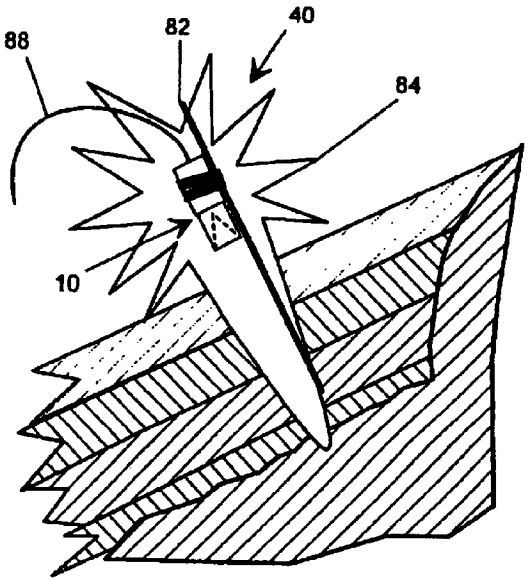
FIGS. 6 to 8 are diagrammatic views of the use of an explosive device which is as the device of FIG. 1 but with a support stick affixed to it.
Figure 6:
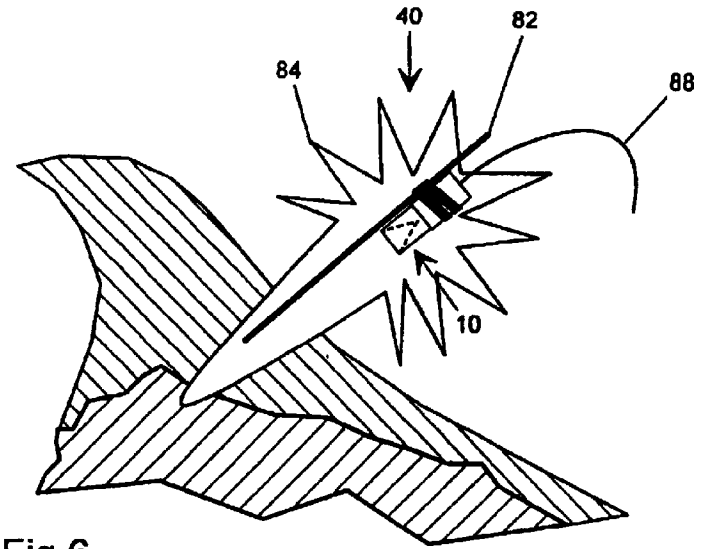
Figure 8:
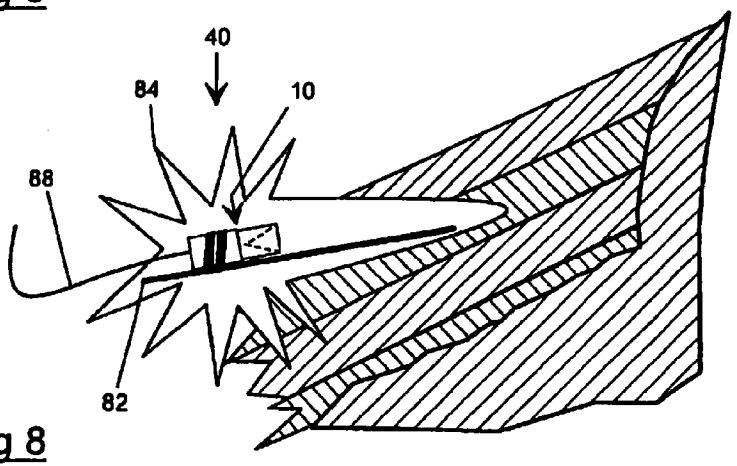

FIGS. 6 to 8 illustrate the use of an explosive device 40 which is as device 10 of FIG. 1 but with a support stick 82 affixed to it so the device can be positioned and orientated as required on a snow slab. The device 40 includes a pyrotechnic fuze 88. The highly focused blast emission produced by the enhanced blast charge 10 is indicated schematically by the extended, highly schematic "star" shaped blast envelope 84. They respectively illustrate the use of the device for cornice overhang removal with the device 40 providing combined air shock and deep penetration, slab blasting with the device providing combined air shock and deep penetration perpendicular to the snow slab, and slab blasting where the device is orientated to provide superficial disruption of the surface layer of a snow slab.

Figure 9:
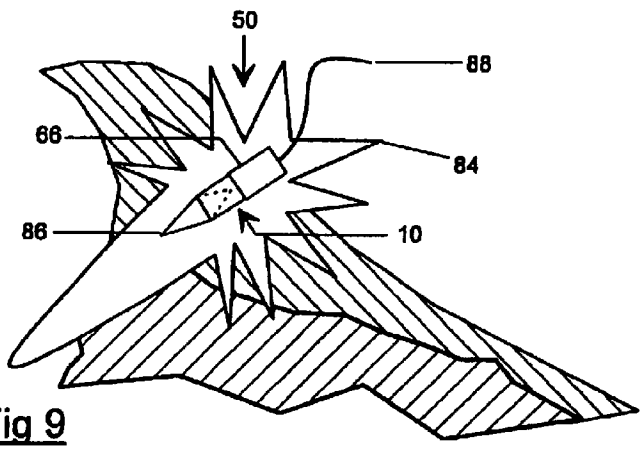
FIG. 9 is a diagrammatic view of a further embodiment of the present invention for cornice control.

FIG. 9 shows a further use of the present invention for cornice control. The device 50 is as the device 10 of FIG. 1 but includes a pyrotechnic fuze 88 and a conical end cap 86 to aid penetration into the soft back of the cornice following remote delivery of the device from a short range launcher system, typically a cross bow.

Figure 10:
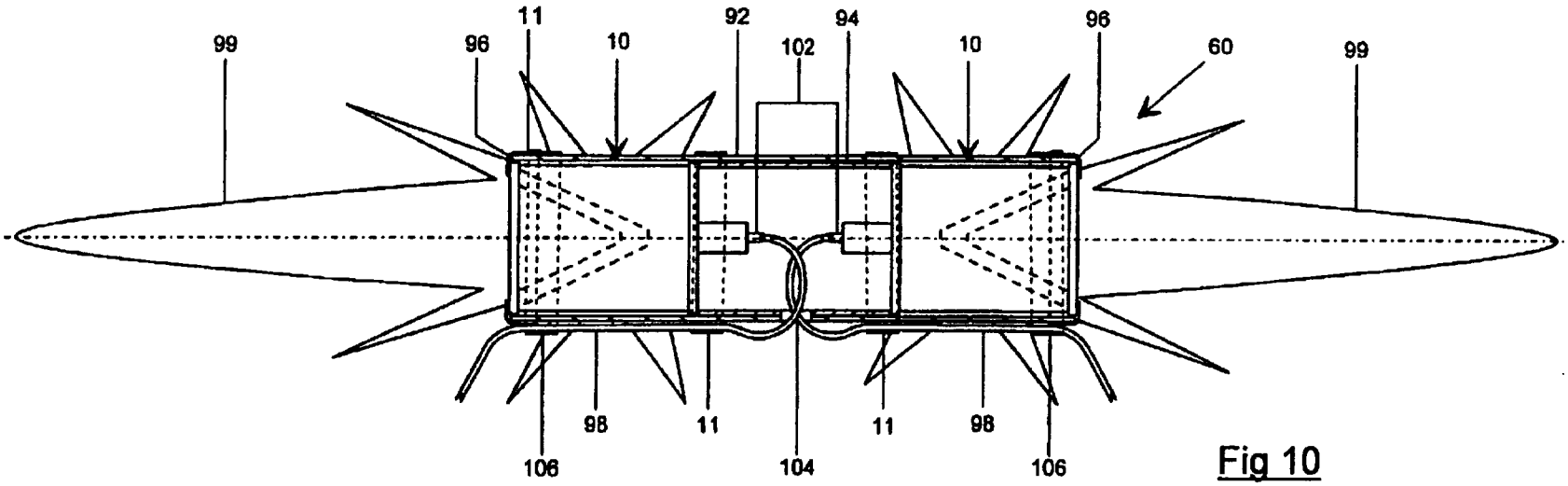
FIG. 10 is a further diagrammatical sectional view of a further embodiment of an assembly comprising two devices of FIG. 1.

FIG. 10 shows a further embodiment of the present invention, namely an assembly 60 comprising two devices 10 of FIG. 1, located back to back within a thin cardboard tube 92. A smaller diameter cardboard tube 94, located inside the main tube 92, holds the devices apart and tape 96 at each end retains the two devices 10 in place. Each device 10 is connected to an identical length of shock tube 98 (Dyno-Nobel Starter Line), terminated at the charge end by an instantaneous standard detonator cap 102. The starter lines 98 pass out of the locating tubes 92 and 94 via hole 104 and are fixed securely to the outer tube 92 by adhesive tapes 106.

The assembly 60 of FIG. 10 produces a simultaneous detonation of the charges 10 which project a highly focused axi-symmetric blast wave travelling in opposite directions along the axis of the assembly as indicated by the blast envelope 99.

Figure 11:
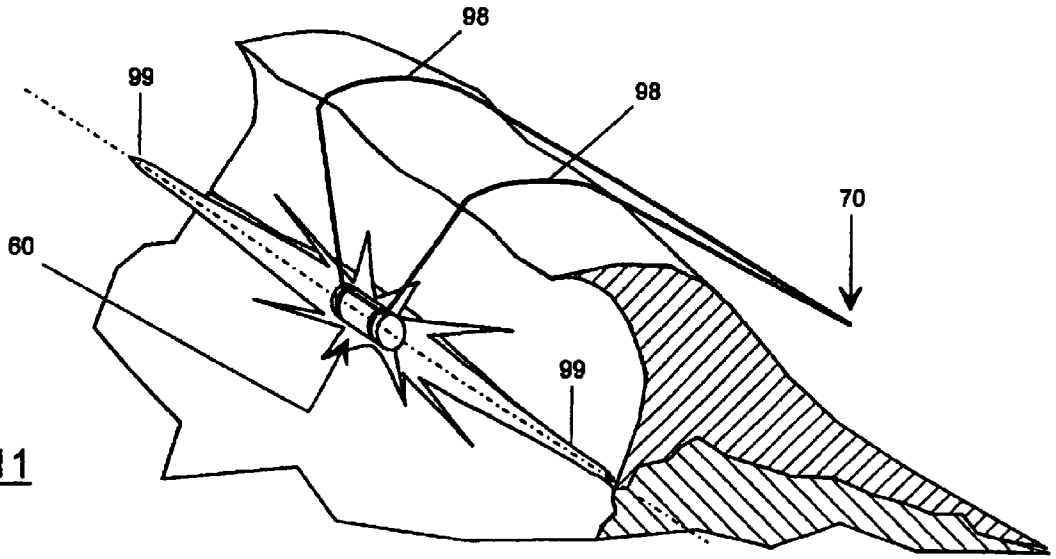
FIG. 11 is a diagrammatic view of a typical application of the device of FIG. 10 for avalanche control.

FIG. 11 shows a typical application for the device 60 of FIG. 10 for avalanche control. The assembly 60 is arranged to overhang a cornice build up such that the axis of the charge is parallel to the line of the cornice. The two starter lines 98 are initiated simultaneously from a firing point 70 in known manner.

Figure 12:
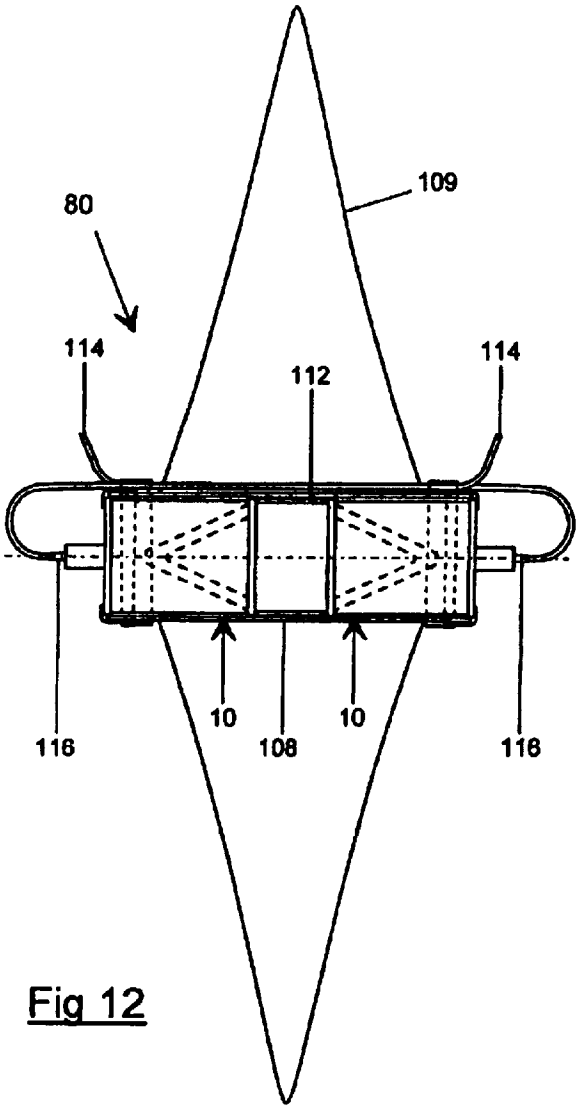
FIG. 12 is a diagrammatic sectional view of a further embodiment of an assembly comprising two devices of FIG. 1.

FIG. 12 shows a further embodiment of the present invention, namely an assembly 80 comprising two devices 10 of FIG. 1, located face to face within a thin cardboard tube 108. A smaller diameter cardboard tube 112, located inside the main tube 108, establishes a separation between the charges 10 that can be changed in length to alter the output of the charge assembly. The charges 10 are retained in the outer tube 108 by adhesive tape as described for FIG. 10. Each device 10 is connected to an identical length of shock tube 114 (Dyno-Nobel Starter Line), terminated at the charge end by an instantaneous standard detonator cap 116. The two starter lines are then crossed over the outer tube 108 and taped securely as described for FIG. 10.

The assembly 80 of FIG. 12 produces simultaneous detonation of the charges. When the jets formed by the two shaped charge liners collide, in accordance with simple principles of momentum balance, a symmetrical 360 degree disk of high pressure products 109 is emitted in a plane at 90 degrees to the axis of the two charges.

Figure 13:
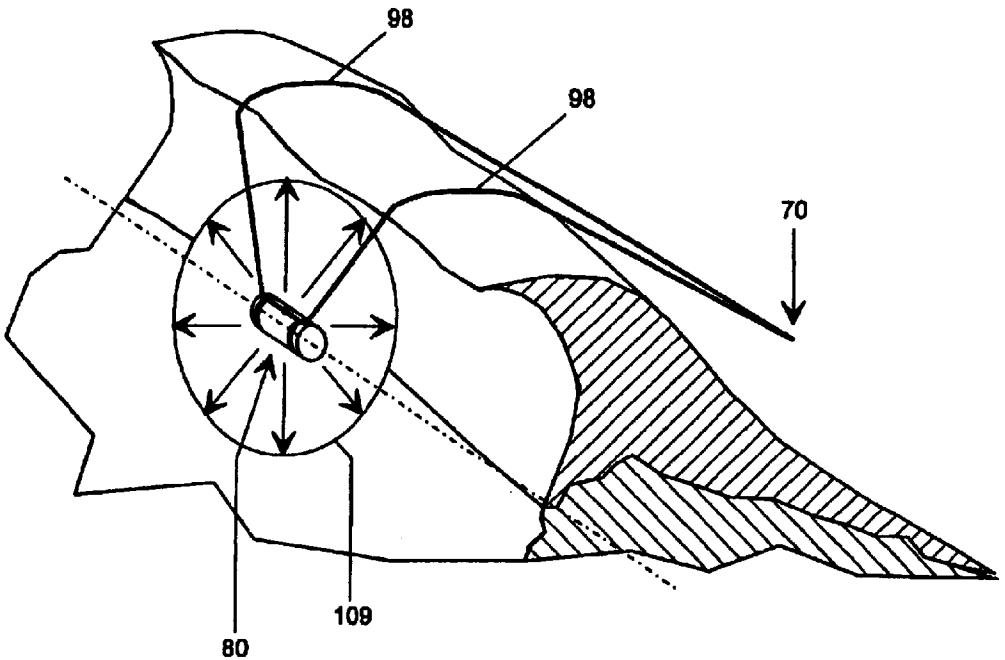
FIG. 13 is a diagrammatic view of a typical application for the device of FIG. 12 for avalanche control.

FIG. 13 shows a typical application for the device of FIG. 12 for avalanche control. The assembly 60 is arranged to overhang a cornice build up such that the axis of the charge is parallel to the line of the cornice. The two starter lines 98 are initiated simultaneously from the firing point 70. This arrangement may be equally effective if suspended such that the axis of the assembly 80 runs vertically.

Figure 14:
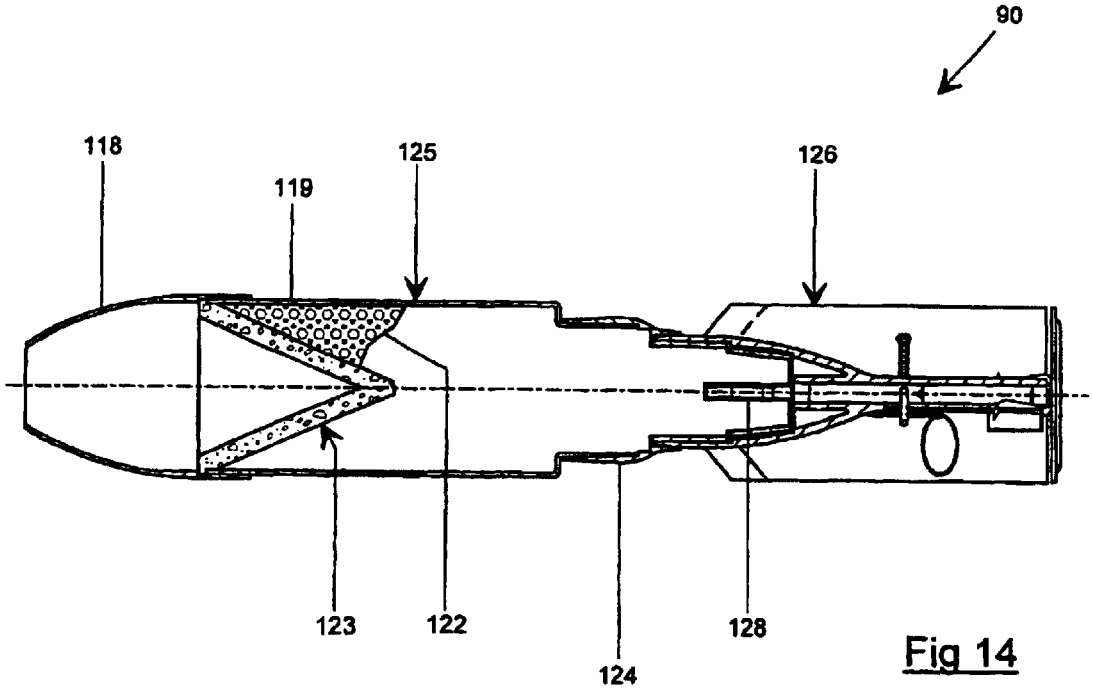
FIG. 14 is a diagrammatic sectional view of a further embodiment of the invention within the body of a modified Avalauncher gas gun round.

FIG. 14 shows an embodiment 90 of the current invention within the body of a modified Avalauncher gas gun round 90. An assembly 125 consists of a plastics nose cone 118, a full calibre body shell 119, containing the explosive filling 122, and an enhanced blast shaped charge liner assembly 123, as described for device 10 of FIG. 1, and a plastics tail fin adaptor 124 of known form. The explosive charge assembly 125 is stored separately from a known tail fin assembly 126, which embodies the safety and arming mechanism (not detailed) and detonator 128. This configuration significantly improves the performance of the standard Avalauncher blast round as shown in FIGS. 3 and 4, respectively.

Figure 15:
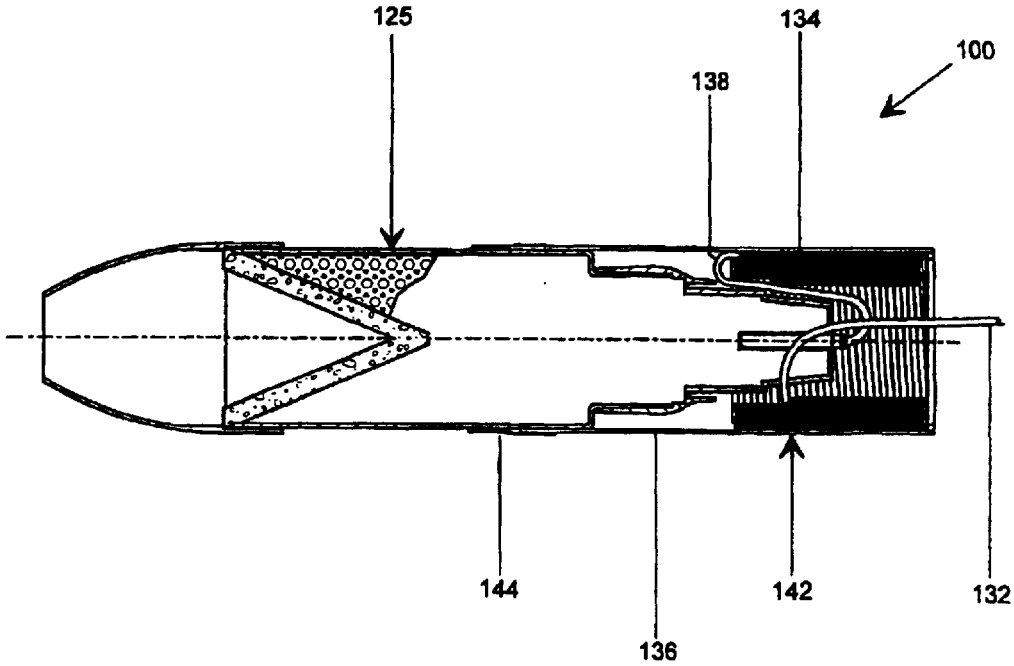
FIG. 15 is a diagrammatic sectional view of a further application of the explosive charge assembly of FIG. 14.

FIG. 15 shows a further embodiment 100 employing the above explosive charge assembly 125 but this time in conjunction with the shock tube firing and control system described in detail filed in copending British Patent Application No 9915586.3 the entire contents of which are incorporated by reference into this application. This embodiment 100 is a cost effective engineering solution, for application of the experimental configurations described in FIGS. 1 and 2, to hand charge avalanche control operations. Briefly, the free end 132 of a Dyno-Nobel starter line is attached to the operator (not shown). The remainder of the starter line is coiled as a coil 134 within a cardboard spool tube 136, eventually terminating at a detonator end 138 forming a spool assembly 142 which is retained 144 on the body of the Avalauncher explosive charge assembly 125 by adhesive tape 144. The charge assembly 100 may be thrown or launched to the desired position, the first end 132 of the starter line being subsequently detached from the operator and connected to a firing pack (not shown) ready for firing.

Figure 16:
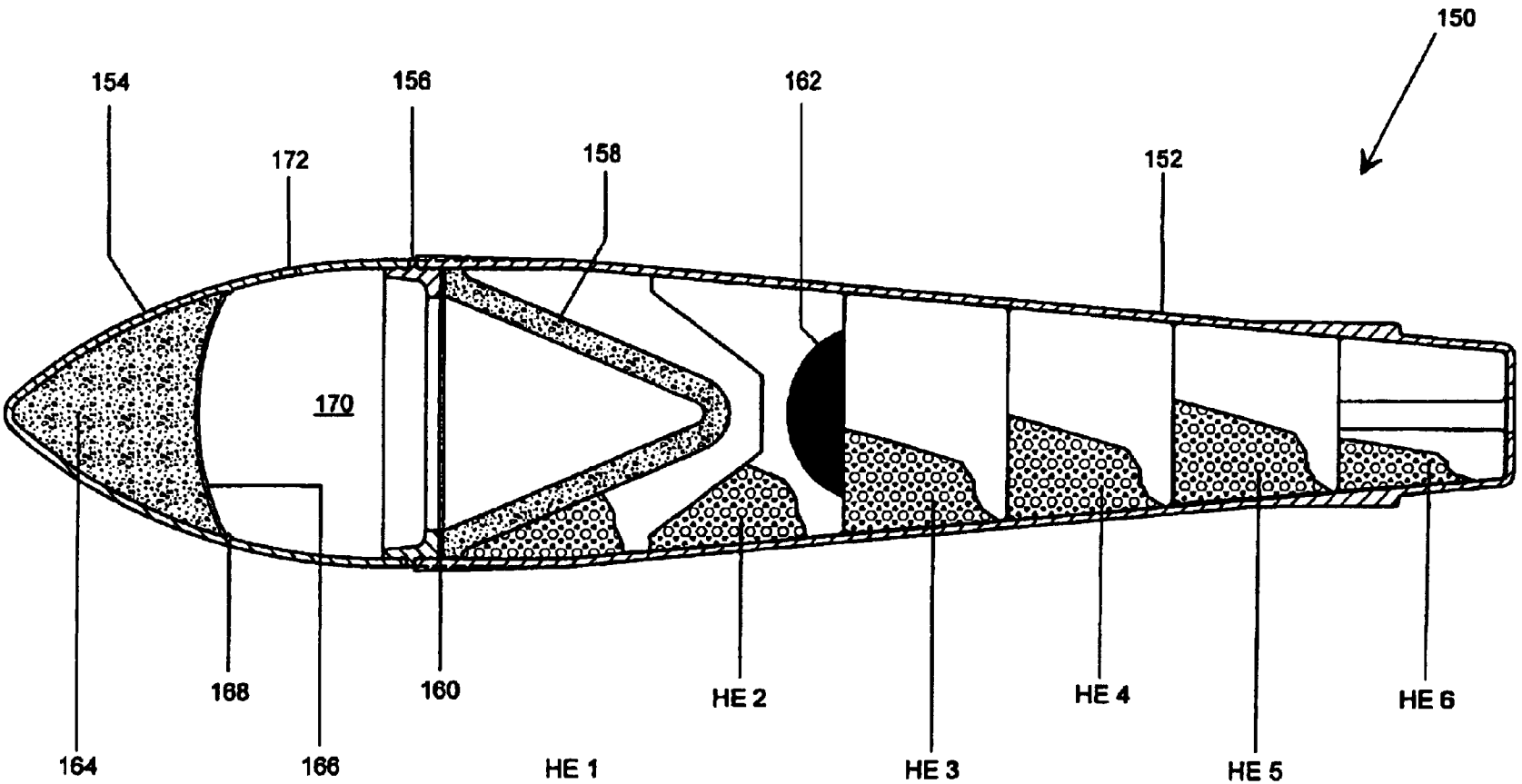
FIG. 16 is a diagrammatic sectional view of a further embodiment of the present invention.

Referring now to FIG. 16, this embodiment of the present invention is a round 150 having a body 152 and nacelle 154, both of injection moulded polypropylene, joined together by a joint ferrule 156, also of polypropylene, held together by pairs of male/female clip rings (not shown) moulded into the three components 152, 154, 156.

The body 152 is tapered to minimise aerodynamic drag and has the necessary base features to interface with previous described aerodynamic fin 126 and firing assembly of FIG. 14.

The nacelle also provides aerodynamic streamlining and a stand off between the mouth of a shaped charge liner 158 and target material (not shown). Alternative nacelle shapes could be employed to control the detonation delay time in soft snow pack, for example.

The joint ferrule 156 also retains the liner 158 and a series of HE pellets $HE_1$ to $HE_6$ within the body component. Note that there is a 1 mm clearance gap between the liner 158 and joint ferrule 156 to accept a soft packing washer 160 to control thermal effects and tolerance build-up.

The liner 158 is pressed from aluminium powder bound with paraffin wax, this allows a broad range of different liner compositions to be introduced to adjust performance to suit varying conditions and/or alternative applications. A range of different liner geometries can also be used for the $HE_1$ pellet. The liner 158 of this embodiment has a density of 1.7 g/cc.

The explosive charge consists of a set of pre-pressed pellets $HE_1$ to $HE_6$. This construction allows a range of different explosive compositions to be introduced to adjust performance to suit varying conditions and/or alternative applications. Typically, aluminised explosive (addition of up to 20% of Al. powder) significantly enhances blast yield from pellets $HE_3$, $HE_4$, $HE_5$ and $HE_6$, but pellets $HE_1$ and $HE_2$ could be a high density HMX and/or RDX/wax composition, more ideally suited to the shaped charge function. However, all pellets ($HE_1$ to $HE_6$) could be aluminised to optimise blast yield.

A wave shaping barrier 162 (injection moulded polypropylene) shapes the geometry of the detonation from and influences the way in which the shaped charge liner collapses. A broad range of different effects can be both introduced and controlled by altering the shape of the barrier 162. The introduction of a separate pellet that accommodates the barrier feature pellet $HE_2$ allows for such changes to be made at will.

The nacelle 154 has a bead 168 round the inside of the nacelle 154 tapered rearwardly to permit a bowed plenum 166 to be pushed forwardly over the bead 168 and held in position inside the nacelle 154.

The front most region of the interior volume of the nacelle 154 is filled with aluminium powder 164 and held in place by the plenum 166 but other materials can be placed there, eg aluminised paraffin wax.

A throughhole 172 in the nacelle 154 allows the injection of a low density filler, eg polyurethane foam, about 0.01 $gm/cm^2$, to fill the volume 170 which is in the collapse zone forward of the liner 158. This adds rigidity to the forward structure of the device and provides support to the liner 158 so permitting the use of more frangible liners than otherwise possible.

The material 164 in the nacelle 154, if present, is energised, dispersed and propelled forward by the jet formed on detonating the device, to react with either the target material and/or the atmosphere ahead of the nacelle.

An alternative embodiment of the device of FIG. 16 is one in which there is no particulate material 164. In a further embodiment, the liner 158 may be omitted, with suitable dimension changes of the pellet $HE_1$ to accommodate the gap that would otherwise be present between it and the washer 160 or replaced by a liner not having any dispersible material in its composition. Such an embodiment would be applied where minimal penetration effects were required, typically, the production of a highly directional gaseous blast effect. The magnitude of the focused blast effect could be further enhanced by causing the gaseous jet formed by the cavity in the explosive to interact with a particulate or reactive material 164 contained within the nacelle.

Although the use of present invention has been described in terms of avalanche control applications, the benefits of controlled and highly directional cutting, perforation or stimulation of secondary reactions of explosive devices according to the present invention has a wide range of other potential applications. These include:

rapid generation of wide access holes in concrete/rock walls in support of rescue and recovery operations, where a range of liner materials and particle sizes for the liner can be chosen to control the nature of the cut and/or residual particle penetration into sensitive areas behind;

the use of directing the highly focused blast effects to combat and extinguishing burning oil wells;

rapid internal cutting of narrow bore, thick walled pipes, typical of well liners and drilling shafts; and spalling of loose rock from chamber roofs in underground mines, civil tunnelling and mining operations and underwater engineering operations.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method of blasting a snow or ice formation target including a given material comprising, (a) providing a hollow charge explosive device including an explosive charge defining at least one boundary wall of a cavity and including particulate material located forward of said boundary wall so as to be dispersible by said explosive charge when detonated, said particulate material being selected to be one which reacts with water on detonation of the explosive device, (b) positioning said explosive device in a predetermined position relative to the snow or ice formation target, and (c) detonating said explosive device thereby triggering an avalanche.

2. A method as claimed in claim 1, in which said explosive device is positioned by launching said explosive device by hand or by mechanical or chemical propulsion.

3. A method as claimed in claim 1, wherein said particulate material is included in a liner, said liner lining said cavity.

4. A method as claimed in claim 3, in which said liner comprises an inner liner skin and an outer liner skin spaced apart from said inner line skin, and said particulate material is a loose powder located between said inner liner skin and said outer liner skin.

5. A method as claimed in claim 4, wherein said inner liner skin and said outer liner skin are formed from a glass reinforced plastics material.

6. A method as claimed in claim 1, in which said particulate material is embedded in a solid binder.

7. A method as claimed in claim 1, in which said particulate material has been consolidated by mechanical pressure.

8. A method as claimed in claim 1, in which said particulate material is aluminum powder.

9. A method as claimed in claim 1, in which said particulate material reacts with a predetermined target medium.

10. A method as claimed in claim 1, further comprising a nacelle forward of said cavity, and wherein said particulate material is located in said nacelle.

11. A method as claimed in claim 1, wherein said device is embodied in a gun firable or hand throwable, or mechanically or chemically launchable projectile.

12. A method as claimed in claim 1, wherein said device includes a liner which liner includes aluminum powder bound by wax.

13. A method as claimed in claim 12, wherein said wax is paraffin wax.

14. A method as claimed in claim 1, wherein said explosive charge includes two or more high explosive pellets.

15. A method as claimed in claim 14, wherein one or more of the high explosive pellets is aluminized.

* * * * *